US009831542B2

(12) United States Patent
Wu et al.

(10) Patent No.: US 9,831,542 B2
(45) Date of Patent: Nov. 28, 2017

(54) ANTENNA SYSTEM

(71) Applicants: Xiaopu Wu, Shenzhen (CN); Yongli Chen, Shenzhen (CN)

(72) Inventors: Xiaopu Wu, Shenzhen (CN); Yongli Chen, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 36 days.

(21) Appl. No.: 15/082,102

(22) Filed: Mar. 28, 2016

(65) Prior Publication Data

US 2017/0012344 A1 Jan. 12, 2017

(30) Foreign Application Priority Data

Jul. 10, 2015 (CN) ..... 2015 2 0500898 U

(51) Int. Cl.
*H01Q 1/24* (2006.01)
*H01Q 1/48* (2006.01)
*H01Q 5/328* (2015.01)

(52) U.S. Cl.
CPC ..... *H01Q 1/243* (2013.01); *H01Q 1/24* (2013.01); *H01Q 1/48* (2013.01); *H01Q 5/328* (2015.01)

(58) Field of Classification Search
USPC ..... 343/702, 700 MS
See application file for complete search history.

(56) References Cited

U.S. PATENT DOCUMENTS

2014/0087674 A1* 3/2014 Teng ..... H01Q 5/35 455/90.3
2014/0333495 A1* 11/2014 Vazquez ..... H01Q 9/06 343/745

* cited by examiner

*Primary Examiner* — Jessica Han
*Assistant Examiner* — Hai Tran
(74) *Attorney, Agent, or Firm* — Na Xu; IPro, PLLC

(57) ABSTRACT

An antenna system applicable to a mobile communication device is provided in the present disclosure. The antenna system includes a metal frame; a grounding unit surrounded by the metal frame, and an internal antenna. One end of the grounding unit cooperates with the metal frame to form a clearance area, and the internal antenna is located in the clearance area. The internal antenna includes a feeding portion and a radiating portion; the radiating portion is spaced from the metal frame and is coupled to the metal frame. The feeding portion is connected to a feed source via a feed line.

11 Claims, 2 Drawing Sheets

ANTENNA SYSTEM

FIELD OF THE DISCLOSURE

The present disclosure generally relates to antenna technologies, and more particularly, to an antenna system applicable to a mobile communication device.

BACKGROUND

With the development of mobile communication technologies, mobile communication devices such as mobile phones, tablet computers, laptops, or the like, are used more and more widely. Mobile communication devices with metal frames are preferred by people because of their fashion appearance as well as good durability.

Mobile devices normally use antenna systems to convert electric power into radio waves, and vice versa, so as to enable the mobile devices to perform wireless transmission and reception. However, a metal frame may bring an electromagnetic shielding effect against the antenna system of the mobile communication device. In order to improve a radiation space of the antenna system, in a related mobile communication device, the metal frame is configured to serve as a radiating part of the antenna system.

For example, the antenna system includes a metal frame and a system grounding unit connected to the metal frame. The metal frame is a ring-shaped metal frame surrounding the system grounding unit, and a ground line and a feed line are disposed on the metal frame. To enable the antenna system to have multiple available frequency bands, a plurality of radiation gaps may be formed in the metal frame of the antenna system, and the antenna system may feed to the radiation gaps directly.

However, a frequency band range of the above-mentioned antenna system with the radiation gaps is still narrow, and the radiation gaps formed in the metal frame may impact the appearance and integrality of the metal frame; moreover, the radiation gaps need to be formed by an extra manufacturing process, which increases an overall cost of the antenna system.

Therefore, it is necessary to provide a new antenna system which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an embodiment thereof.

Figure 1:
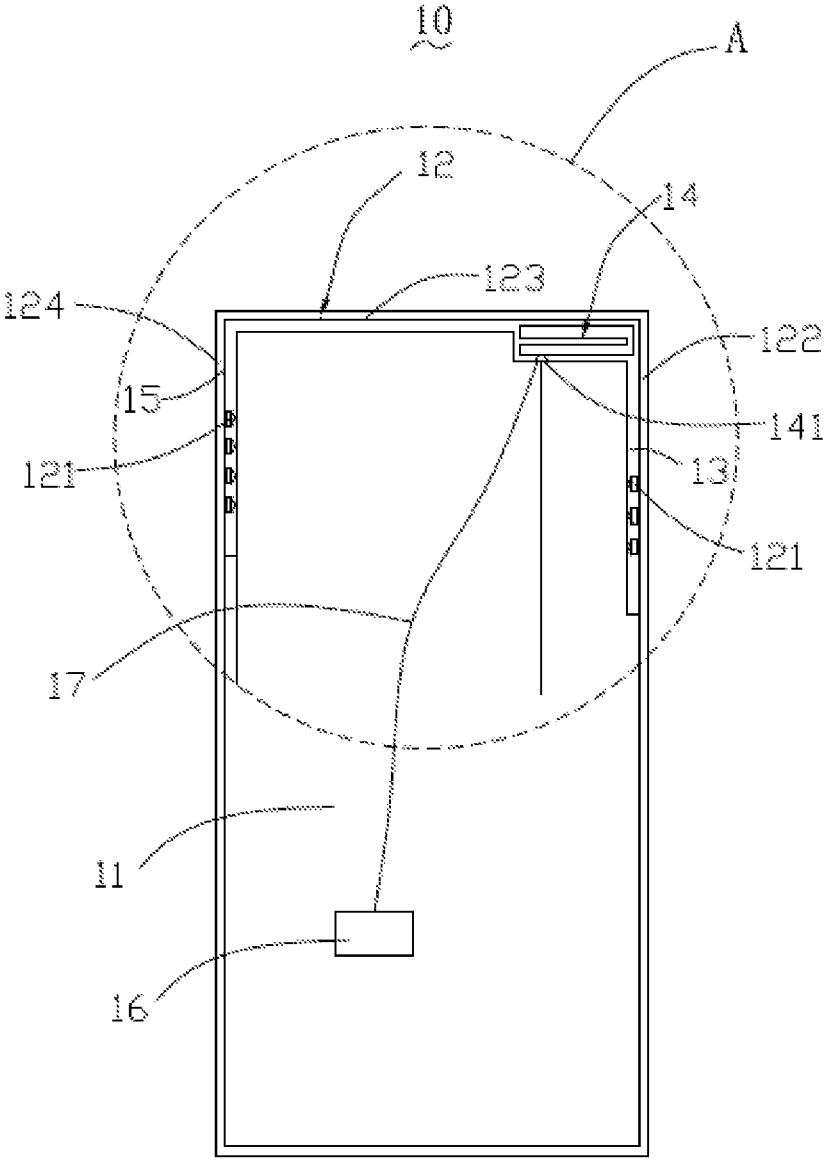
FIG. 1 is a planar view of an antenna system according to an exemplary embodiment of the present disclosure.
Figure 2:
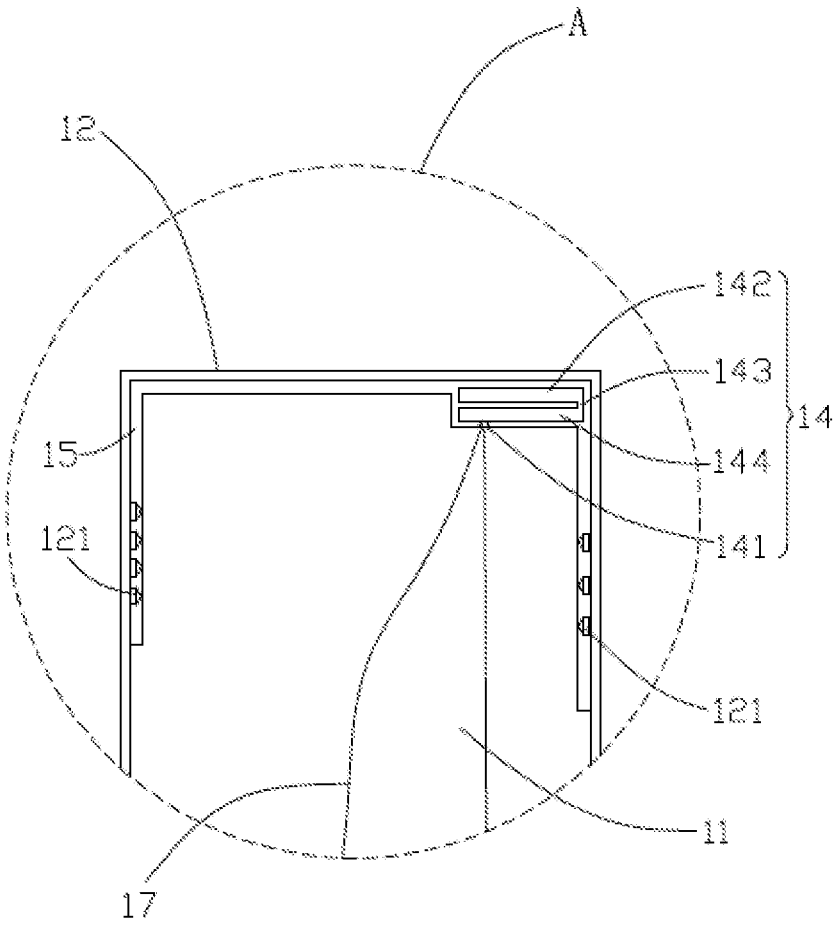
FIG. 2 is an enlarged, partial view of the antenna system of FIG. 1.

Referring to FIGS. 1 to 2, an antenna system 10 according to an exemplary embodiment of the present disclosure includes a grounding unit 11, a metal frame 12 and an internal antenna 14.

The metal frame 12 surrounds the grounding unit 11, and includes a first part connected to the grounding unit 11 and a second part spaced from the grounding unit 11. A clearance area is formed corresponding to the second part of the metal frame 12, and the internal antenna 14 is located in the clearance area. The internal antenna 14 includes a radiating portion 142~144 and a feeding portion 141 electrically connected to the radiating portion 142~144. The radiating portion 142~144 is separated from the metal frame 12 at a certain distance to form a gap therebetween, and is coupled to the metal frame 12 via the gap. Furthermore, the feeding portion 141 is connected with a feed source 16 via a feed line 17, and the feed line 17 is configured as a signal transmission line of the antenna system 10.

In the present embodiment, the gap is formed between the internal antenna 14 and the metal frame 12 to provide a coupling feeding configuration, and thus, a bandwidth of the antenna system 10 can be expanded, and the antenna system 10 is enabled to cover a wide frequency band range.

The second part of the metal frame 12 includes a first frame unit 122, a second frame unit 124 parallel to the first frame unit 122, and a third frame unit 123 perpendicularly connected between the first frame unit 122 and the second frame unit 124. The first frame unit 122 may cooperate with either the second frame unit 124 or the third frame unit 123 to form a receiving space for receiving the internal antenna 14. For example, in the present embodiment, the first frame unit 122 and the third frame unit 124 cooperatively from the receiving space in a top right corner of the metal frame 12; the internal antenna 14 is received in the receiving space, and is spaced from the third frame unit 123 and the first frame unit 122 respectively.

As illustrated in FIG. 2, the radiating portion 142~144 of the internal antenna 14 is a U-shaped radiating portion, and includes a first radiator 142, a second radiator 144 parallel to the first radiator 142, and a third radiator 143 connected to both the first radiator 142 and the second radiator 144. The first radiator 142 is parallel and adjacent to the third frame unit 123 at a certain distance, and is coupled to the third frame unit 123. The third radiator 143 is parallel and adjacent to the first frame unit 122 at a certain distance, and is coupled to the first frame unit 122. Moreover, the radiating portion 142~144 includes an opening opposite to the third radiator 143, and the opening faces the second frame unit 124.

Alternatively, in another embodiment, the receiving space may be formed by the second frame unit 124 and the third frame unit 123 in a top left corner of the metal frame 12. In this case, the U-shaped radiating portion 142~144 is disposed in such a manner that the first radiator 142 and the third radiator 143 of the internal antenna 14 is adjacent to but spaced from the third frame unit 123 and the second frame unit 124 respectively, and the opening thereof faces the first frame unit 122. It should be noted that in other embodiment, a structure and shape of the internal antenna 14 is not limited to the aforesaid description.

In the antenna system 10 as provided in present disclosure, the internal antenna 14 is coupled to the metal frame 12 through the gap between the internal antenna 14 and the metal frame 12; this can expand an available frequency band range of the metal frame 12. Moreover, it is unnecessary to form any radiation gap in the metal frame 12, which can not only reduce cost for manufacturing the metal frame 12, but also maintain good appearance and integrality of the metal frame 12.

Furthermore, a first groove 13 may be formed between the first frame unit 122 and the grounding unit 11, and a second groove 15 may be formed between the second frame unit 124 and the grounding unit 11. A plurality of matching units 121 may further be provided in at least one of the first groove 13 and the second groove 15. For example, in the present embodiment as illustrated in FIG. 1, the matching units 121 are provided in both the first groove 13 and the second groove 15, and are respectively fixed on the first frame unit 122 and the second frame unit 124. The matching units 121 are frequency band matching units, and configured for generating different frequency bands to improve frequency band stability of the antenna system 10, and thus improving reliability of a mobile communication device using the antenna system 10.

In the present disclosure, the matching units 121 provided on the metal frame 12 can be either passive components or active components. For example, each of the matching units 121 may be a passive component such as a lumped element, namely, a circuit component or assembly having a profile size much smaller than a wavelength of an electromagnetic wave passing therethrough. Each of the matching units 121 may alternatively be an active component such as a selectable tuner or a change-over switch. In the present embodiment, the matching units 121 are selectable tuners.

It should also be noted that the numbers and position of the matching units 121 on the metal frame 12 are not limited to the above description; in practice, the matching units 121 can be provided in the antenna system 10 as needed.

Additionally, in the present embodiment, the feeding portion 141 of the internal antenna 14 may alternatively be connected to the feed source 16 via the matching units 121. With this configuration, the feed source 16 can be modulated by the matching units 121, and the feeding portion 141 is further coupled to the feed source 16 as modulated, thus further expanding and stabling the frequency band range of the antenna system 10.

In the antenna system 10 as provided in the present disclosure, the metal frame 12 is unconnected to the internal antenna 14 to provide a coupling feeding configuration. As such, a frequency band range of the antenna system 10 can be expanded as required; and moreover, no radiation gap need to be formed in the metal frame, this can not only reduce cost for manufacturing the metal frame 12, but also maintain good appearance and integrality of the metal frame 12 as well as a mobile communication device using the metal frame 12.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna system, comprising:

a metal frame;

a grounding unit surrounded by the metal frame; and an internal antenna;

wherein one end of the grounding unit cooperates with the metal frame for forming a clearance area, and the internal antenna is located in the clearance area; the internal antenna comprises a feeding portion and a radiating portion, the radiating portion is spaced from the metal frame and is coupled to the metal frame; the feeding portion is connected to a feed source via a feed line, wherein the metal frame comprises a first part connected to the grounding unit, and a second part spaced from the grounding unit; the second part comprises a first frame unit, a second frame unit parallel to the first frame unit, and a third frame unit perpendicularly connected between the first frame unit and the second frame unit, wherein the third frame unit cooperates with either the first frame unit or the second frame unit for forming a receiving space; the internal antenna is located in the receiving space, wherein a first groove is formed between the first frame unit and the grounding unit, and a second groove is formed between the second frame unit and the grounding unit; a plurality of matching units are provided in at least one of the first groove and the second groove.

2. The antenna system of claim 1, wherein the radiating portion is a U-shaped radiating portion which includes a first radiator, a second radiator parallel to the first radiator, a third radiator connected to both the first radiator and the second radiator.

3. The antenna system of claim 2, wherein an opening of the U-shaped radiating portion faces the second frame unit, and is opposite to the third radiator.

4. The antenna system of claim 2, wherein the feeding portion is connected to the feed source via the matching units.

5. The antenna system of claim 4, wherein each of the matching units is an active component.

6. The antenna system of claim 5, wherein the active component is a selectable tuner or a change-over switch.

7. The antenna system of claim 4, wherein each of the matching units is a passive component.

8. The antenna system of claim 7, wherein the passive component is a lumped element.

9. An antenna system, comprising:

a metal frame;

a grounding unit surrounded by the metal frame; and an internal antenna;

wherein the metal frame comprises a first part connected to the grounding unit, and a second part spaced from the grounding unit; a clearance area is formed corresponding to the second part, and the internal antenna is located in the clearance area; the internal antenna comprises a feeding portion and a radiating portion, the radiating portion is spaced from the metal frame and is coupled to the metal frame; the feeding portion is connected to a feed source by a feed line, wherein the second art comprises a first frame unit a second frame unit parallel to the first frame unit, and a third frame unit perpendicularly connected between the first frame unit and the second frame unit, wherein the third frame unit cooperates with either the first frame unit or the second frame unit for forming a receiving space, and the internal antenna is located in the receiving space, wherein a first groove is formed between the first frame unit and the grounding unit and a second groove is formed between the second frame unit and the grounding unit a plurality of matching units are provided in at least one of the first groove and the second groove.

10. The antenna system of claim 9, wherein the radiating portion is a U-shaped radiating portion which includes a first radiator, a second radiator parallel to the first radiator, a third radiator connected to both the first radiator and the second radiator.

11. The antenna system of claim 10, wherein an opening of the U-shaped radiating portion faces the second frame unit, and is opposite to the third radiator.

* * * * *